United States Patent [19]

Hiraga et al.

[11] Patent Number: 4,586,874

[45] Date of Patent: May 6, 1986

[54] REFRIGERANT COMPRESSOR WITH A CAPACITY ADJUSTING MECHANISM

[75] Inventors: Masaharu Hiraga, Honjo; Tamotsu Daikohara, Gunma, both of Japan

[73] Assignee: Sanden Corporation, Japan

[21] Appl. No.: 684,577

[22] Filed: Dec. 21, 1984

[30] Foreign Application Priority Data

Dec. 23, 1983 [JP] Japan ..... 58-242128

[51] Int. Cl.[4] ..... F04B 1/26

[52] U.S. Cl. ..... 417/222; 417/270

[58] Field of Search ..... 92/12.2; 417/222, 269, 417/270

[56] References Cited

U.S. PATENT DOCUMENTS

| | | | |
|---|---|---|---|
| 3,010,403 | 11/1961 | Zubaty | 92/12.2 |
| 4,037,993 | 7/1977 | Roberts | 417/222 |
| 4,073,603 | 2/1978 | Abendschein | 417/222 |
| 4,145,163 | 3/1979 | Fogelberg | 417/222 |
| 4,149,830 | 4/1979 | Woodruff | 417/222 |
| 4,174,191 | 12/1979 | Roberts . | |
| 4,475,871 | 10/1984 | Roberts | 417/270 |

*Primary Examiner*—William L. Freeh

*Attorney, Agent, or Firm*—Banner, Birch, McKie & Beckett

[57] ABSTRACT

A reciprocating piston type refrigerant compressor includes a compressor housing having a cylinder block provided with a plurality of cylinders and a crank chamber adjacent the cylinder block. A piston slides within each cylinder and is reciprocated by a wobble plate driven by a cam rotor mounted on a drive shaft. The cam rotor includes an adjustable slant plate with a sloping surface at an adjustable slant angle in close proximity to the wobble plate. Accordingly, the stroke of the pistons within the cylinders can be changed by adjusting the slant angle of the sloping surface. The slant angle of the sloping surface is adjusted in response to the change of pressure in the crank chamber. The crank chamber communicates with the suction chamber through a passageway and a valve control mechanism controls the opening and closing of the passageway. Thus, the capacity of the compressor of the present invention can be adjusted by changing the slant angle of the sloping surface of the slant plate in response to operation of the valve control mechanism.

6 Claims, 1 Drawing Figure

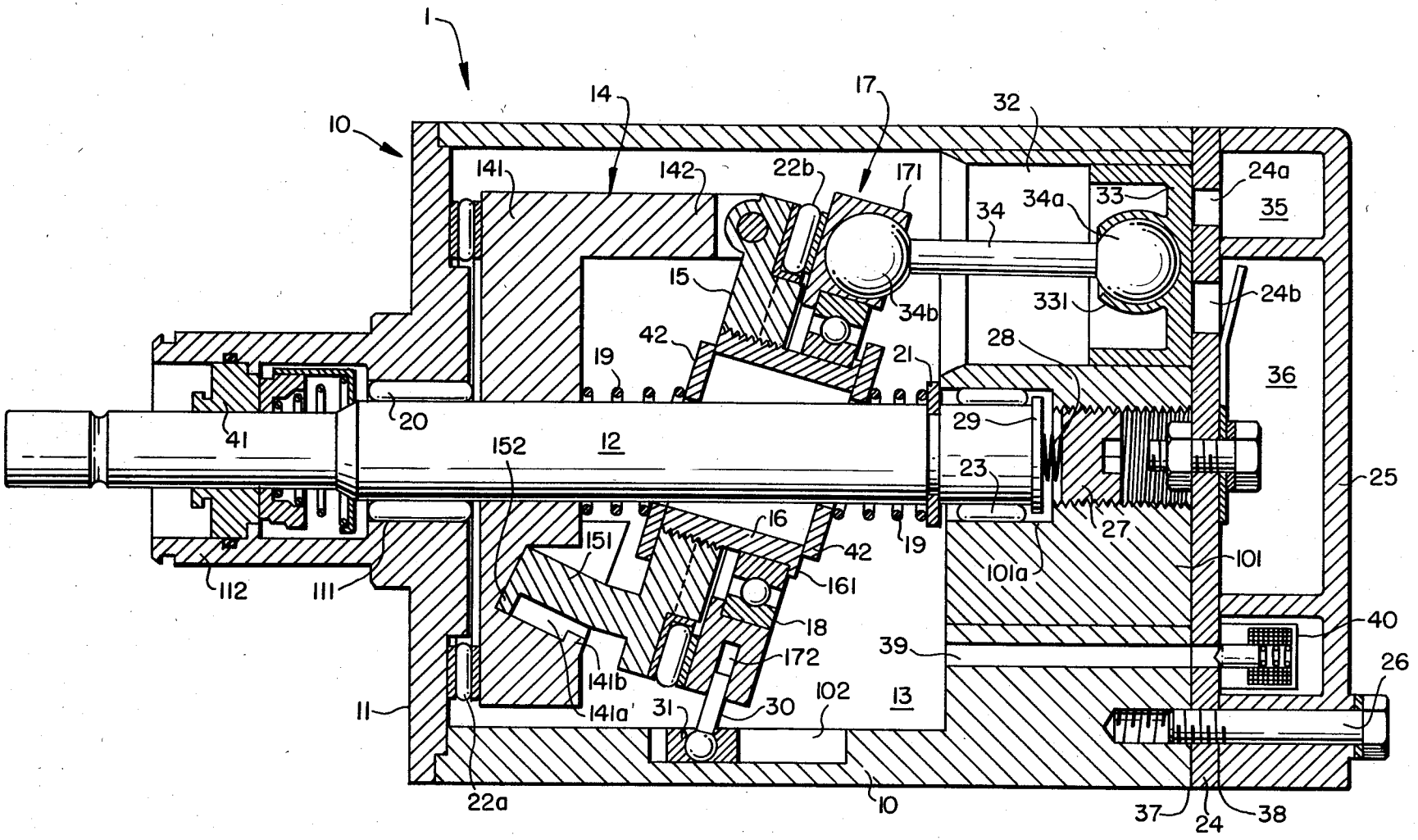
25
40
26
24a
35
24b
36
101
38
24
37
33
27
34a
331
32
34
28
29
23
101a
171
34b
21
19
39
13
10
17
42
161
102
22b
18
172
16
30
15
142
42
31
14
19
12
151
141b
141a
152
141
22a
1
20
11
10
111
41
112

REFRIGERANT COMPRESSOR WITH A CAPACITY ADJUSTING MECHANISM

BACKGROUND OF THE INVENTION

The present invention relates to a refrigerant compressor, and more particularly, to a wobble plate type piston compressor for an air conditioning system in which the compressor includes a mechanism for adjusting the capacity of the compressor.

Generally, in air conditioning apparatus, thermal control is accomplished by intermittent operation of the compressor in response to a signal from a thermostat located in the room being cooled. Once the temperature in the room has been lowered to a desired temperature, the refrigerant capacity of the air conditioning system generally need not be very large in order to handle supplemental cooling because of further temperature changes in the room or for keeping the room at the desired temperature. Accordingly, after the room has cooled down to the desired temperature, the most common technique for controlling the output of the compressor is by intermittent operation of the compressor. However, this intermittent operation of the compressor results in the intermittent application of a relatively large load to the driving mechanism of the compressor in order to drive the compressor.

In automobile air conditioning compressors, the compressor is driven by the engine of the automobile through an electromagnetic clutch. These automobile air conditioning compressors face the same intermittent load problems described above once the passenger compartment reaches a desired temperature. Control of the compressor normally is accomplished by intermittent operation of the compressor through the electromagnetic clutch which couples the automobile engine to the compressor. Thus, the relatively large load which is required to drive the compressor is intermittently applied to the automobile engine.

Furthermore, since the compressor of an automobile air conditioner is driven by the engine of the automobile, the rotation frequency of the drive mechanism changes from moment to moment, which causes the refrigerant capacity to change in proportion to the rotation frequency of the engine. Since the capacity of the evaorator and condenser of the air conditioner does not change, when the compressor is driven at high rotation, the compressor performs useless work. To avoid performing useless work, prior art automobile air conditioning compressors often are controlled by intermittent operation of the magnetic clutch. Again, this results in a large load being intermittently applied to the automobile engine.

SUMMARY OF THE INVENTION

It is a primary object of this invention to provide an improved refrigerant compressor wherein a mechanism is provided for adjusting the capacity of the compressor in order to eliminate the need for intermittent operation of the compressor.

It is another object of this invention to provide a refrigerant compressor wherein the load on the driving mechanism for driving the compressor is reduced which thereby results in reduced consumption of energy by the compressor.

It is still another object of this invention to provide a refrigerant compressor for an automobile air conditioner which operates without cyclic operation of the electromagnetic clutch.

A refrigerant compressor according to this invention includes a compressor housing having a cylinder block with a plurality of cylinders and a crank chamber adjacent the cylinder block. A piston is slidably disposed within each cylinder and reciprocated by a wobble plate driven by an input cam rotor. The cam rotor is provided with a sloping surface in close proximity to the wobble plate. A drive shaft is connected to the cam rotor and rotatably supported by the compressor housing. A front end plate, which rotatably supports the drive shaft through a bearing, is disposed on an opening of the crank chamber. A rear end plate, which is disposed on the opposite end of the housing, includes a suction chamber and discharge chamber for refrigerant. The rear end plate is fixed on the housing together with a valve plate. The crank chamber and the suction chamber are connected by a passage, the opening and closing of which are controlled by a valve mechanism. The angle of the sloping surface of the cam rotor can be changed in response to pressure changer in the crank chamber. Thus, the stroke of the piston is controlled to adjust the capacity of the compressor.

Further objects, features and other aspects of this invention will be understood from the following detailed description of the preferred embodiment of this invention with reference to the annexed drawing.

BRIEF DESCRIPTION OF THE DRAWING

The single FIGURE is a vertical sectional view of a refrigerant compressor according to the preferred embodiment of this invention.

DETAILED DESCRIPTION OF THE PREFERRED EMBODIMENT

Referring to the drawing, a refrigerant compressor according to the invention is shown. The compressor, which is generally designated by reference numeral I, includes closed cylindrical housing assembly 10 formed by cylinder block 101, a hollow portion such as crank chamber 13, front end plate 11 and rear end plate 25.

Front end plate 11 is mounted on the left end portion of crank chamber 13 by a plurality of bolts (not shown). Rear end plate 25 and valve plate 24 are mounted on cylinder block 101 by a plurality of bolts 26, one of which is shown in FIG. 1. Opening 111 is formed in front end plate 11 for receiving drive shaft 12. Annular sleeve 112 projects from the front end surface of front end plate 11 and surrounds drive shaft 12 to define a shaft seal cavity. Shaft seal assembly 41 is assembled on drive shaft 12 within the shaft seal cavity.

Drive shaft 12 is rotatably supported by front end plate 11 through bearing 20 which is disposed within opening 111. The inner end of drive shaft 12 is provided with a swash plate or cam rotor 14. Thrust needle bearing **22*a* is disposed between the inner end surface of front end plate 11 and the adjacent axial end surface of cam rotor 14. The outer end of drive shaft 12, which extends outwardly from sleeve 112**, is driven by the engine of the vehicle through a conventional clutch and pulley arrangement.

Cam rotor 14 comprises plate body 141 fixed on drive shaft 12 and arm portion 142 axially projecting from plate body 141. Slant plate 15 is coupled with outer end portion of arm portion 142 and is rotatably supported thereby. Slant plate 15 includes axial projection 151 at its outer end surface which extends into sliding groove 141*a* formed in plate body 141. Radial flange portion 152 is formed on the outer end portion of projection 151 and sliding groove 141*a* is provided with radial flange 141*b* at its outer opening. As a result of the above construction of cam rotor 14, the slant angle of slant plate 15 can be changed by movement of projection 151 within sliding groove 141*a*. The range of movement is limited by the length of sliding groove 141*a*, i.e., the movement of projection 151 is limited by engagement of radial flanges 141*b* and 152. The sloping surface of slant plate 15 is placed in close proximity to the surface of wobble plate 17 which is mounted on sleeve member 16 through bearing 18. Axial movement of bearing 18 is prevented by flange 161 on the end portion of sleeve member 16. One end portion of sleeve member 16 is screwed into the central portion of slant plate 15. Therefore, sleeve member 16 is disposed within crank chamber 13 at an axial slot with respect to the center of drive shaft 12. Thrust needle bearing 22*b* is disposed between the sloping surface of slant plate 15 and wobble plate 17.

Washer plates 42 are disposed on the ends of sleeve member 16 for closing the opening in sleeve member 16. Coil spring 19 is disposed between plate body 141 and front washer plate 42, and also between rear washer plate 42 and snap ring 21 disposed on drive shaft 12 to secure the position of sleeve member 16. The inner end portion of drive shaft 12 extends into central bore 101*a* formed in the center portion of cylinder block 101 and is rotatably supported therein by a bearing such as radial needle bearing 23. The position of drive shaft 12 can be adjusted by adjusting screw 27 screwed into the threaded portion of central bore 101*a* and spring device 28 is disposed between the axial end surface of drive shaft 12 and adjusting screw 27. Thrust needle bearing 29 is placed between drive shaft 12 and spring device 28 to ensure smooth rotation of drive shaft 12.

The rotation of wobble plate 17 is prevented by a guide pin or rod 30 which is slidably disposed within bore 172 formed in the bottom end thereof. One end of rod 30 extends into guide member 31 which slides in a longitudinal guide groove 102 formed on the inner peripheral surface of the housing 10.

Cylinder block 101 has a plurality of annularly arranged cylinders 32 in which pistons 33 slide. A typical arrangement includes five cylinders, but a smaller or larger number of cylinders may be provided. All pistons 33 are connected to wobble plate 17 by connecting rods 34. Ball 34*a* at one end of rod 34 is received in socket 331 of piston 33 and ball 34*b* at the other end of rod 34 is received in socket 171 of wobble plate 17. It should be understood that, although only one such ball socket connection is shown in the drawing, there are a plurality of sockets arranged peripherally around wobble plate 17 to receive the balls of various rods, and that each piston 33 is formed with a socket for receiving the other ball of rods 34.

Rear end plate 25 is shaped to define suction chamber 35 and discharge chamber 36. Valve plate mechanism 24, which is fastened to the end of cylinder block 101 by screws 26 together with rear end plate 25, is provided with a plurality of valved suction ports 24*a* connected between suction chamber 35 and the respective cylinders 32, and a plurality of valved discharge ports 24*b* connected between discharge chamber 36 and the respective cylinders 32. Suitable reed valves for suction port 33*a* and discharge port 33*b* are described in U.S. Pat. No. 4,011,029 issued to Shimizu. Gaskets 37, 38 are placed between cylinder block 101 and valve plate 24, and valve plate 24 and rear end plate 25, to seal the mating surfaces of the cylinder block, the valve plate mechanism and the rear end plate.

As shown in the bottom right-hand portion of the drawing, crank chamber 13 is connected with suction chamber 35 through passageway 39 extending through cylinder block 101 of housing 10 and valve plate 24. The opening and closing of passageway 39 is controlled by a valve mechanism 40 disposed within suction chamber 35 of rear end plate 25.

In operation, drive shaft 12 is rotated by the engine of the vehicle through an electromagnetic clutch, and cam rotor 14 is rotated together with drive shaft 12 to cause a non-rotating wobbling motion of wobble plate 17. Rotating motion of wobble plate 17 is prevented by rod 30 which extends from wobble plate 17 and is slidably fitted into sliding groove 102 through guide member 31. As wobble plate 17 moves, pistons 33 reciprocate out of phase in their respective cylinders 32. Upon reciprocation of pistons 33, the refrigerant gas, which is introduced into suction chamber 35 from a fluid inlet port (not shown), is taken into each cylinder 32 and compressed. The compressed refrigerant is discharged to discharge chamber 36 from each cylinder 32 through discharge port 24*b*, and therefrom into an external fluid circuit, for example, a cooling circuit, through a fluid outlet port (not shown). During operation of the compressor, if valve mechanism 40 is operated to open passageway 39, the pressure in crank chamber 13 is maintained at the suction pressure because crank chamber 13 communicates with suction chamber 35 of rear end plate 25 through passageway 39. In this condition, wobble plate 17 usually is urged toward slant plate 15 during the compression stroke of the pistons so that slant plate 15 moves toward plate body 141. Thus, the slant angle of slant plate 15 is maximized relative to a vertical plane through the pivot point of slant plate 15. This results in the maximum stroke of pistons 33 within cylinders 32 which corresponds to the normal refrigerant capacity of the compressor.

On the other hand, if passageway 39 is closed by valve mechanism 40, the pressure in crank chamber 13 is gradually raised and a narrow pressure difference occurs between crank chamber 13 and suction chamber 31. This pressure difference occurs because blow-by gas, which leaks from the cylinder chambers to crank chamber 13 through a gap between the pistons and cylinders during the compression stroke, is contained in crank chamber 13. The movement of pistons 33 is hindered by the pressure difference between crank chamber 13 and suction chamber 31, i.e., as the pressure in the crank chamber approaches the mid-pressure of the compressed gas in the cylinder chambers during the suction stroke, movement of the pistons is hindered because of the slant angle of slant plate 15 gradually decreases until it approaches zero, i.e., slant plate 15 would be perpendicular to the drive shaft. As the slant angle of slant plate 15 decreases, the stroke of the pistons in the cylinders is reduced and the capacity of the compressor gradually decreases. Since it is undesirable to completely stop movement of the pistons because the flow of refrigerant gas and lubricating oil would also stop, some movement of the pistons should be maintained to continue lubricating the compressor. Accordingly, in this invention, the range of adjustment of the slant angle is limited by the engagement of projection 151 of slant plate 15 with bore 141*a* of plate body 141.

As mentioned above, in this invention, the crank chamber of the compressor housing communicates with the suction chamber under the control of a valve mechanism. By selectively operating this valve mechanism, the slant angle of the slope surface of the cam rotor, which is in close proximity to the wobble plate, can be changed in accordance with the change in pressure in the crank chamber. Therefore, the capacity of the compressor of the present invention can be adjusted by operating the valve mechanism to change the slant angle of the sloping surface of the cam rotor because the angular position of the wobble plate and the stroke of the pistons is responsive to the slant angle of this sloping surface. Accordingly, the compressor of the present invention operates without clutch cycling control.

Although the invention has been described in detail in connection with a preferred embodiment, it will be understood by those skilled in the art that this embodiment is only for illustration. Various modifications may be made therein by one skilled in the art without departing from the scope or spirit of this invention, which is only limited by the appended claims.

We claim:

1. In a refrigerant compressor including a compressor housing having a cylinder block provided with a plurality of cylinders and a crank chamber adjacent said cylinder block, a piston slidably fitted within each of said cylinders and reciprocated by a drive mechanism including a wobble plate, an input drive rotor and a drive shaft connected to said input drive rotor to drive said input drive rotor, a front end plate on said compressor housing including a bearing for rotatably supporting said drive shaft and a rear end plate disposed on the opposite end of said compressor housing having a suction chamber and a discharge chamber, the improvement comprising a slant plate mounted on said input drive rotor, said slant plate having a sloping surface at a slant angle in close proximity to said wobble plate; slant angle limiting means associated with said slant plate for limiting the adjustment of the slant angle of said sloping surface within a predetermined range; and slant angle control means for controlling the slant angle of said sloping surface in response to pressure differences between said crank chamber and said suction chamber.

2. The refrigerant compressor of claim 1 wherein said input drive rotor comprises a plate body fixed on said drive shaft, an arm axially projecting from one side surface of said plate body toward said crank chamber and said slant plate is movably coupled to the outer end portion of said arm to permit adjustment of the slant angle of said slant plate.

3. The refrigerant compressor of claim 2 wherein said angle limiting means comprises an axially projecting portion on said slant plate extending into a bore formed in said plate body, said axially projecting portion having a radial flange formed on the outer end portion of said axially projecting portion and said bore having a radial flange near its opening, said radial flanges cooperating to limit the range of adjustment of the slant angle of said slant plate by engagement of said radial flanges.

4. The refrigerant compressor of claim 2 wherein said wobble plate is supported on a sleeve member through a bearing, one end of said sleeve member being screwed into a central portion of said slant plate, the position of said sleeve member within said crank chamber being maintained by coil springs acting against washer plates disposed on both openings of said sleeve member.

5. The refrigerant compressor of claim 1 wherein slant angle control means comprises a passageway between said suction chamber and said crank chamber through said compressor housing and valve control means coupled to said passageway for controlling the opening and closing of said passageway.

6. The refrigerant compressor of claim 5 wherein said valve control means is placed within said suction chamber.

* * * * *